US008267739B2

(12) United States Patent
Ishibashi et al.

(10) Patent No.: US 8,267,739 B2
(45) Date of Patent: Sep. 18, 2012

(54) AUTOMOBILE TOY

(75) Inventors: Noriyuki Ishibashi, Tokyo (JP); Yoshio Suimon, Tokyo (JP)

(73) Assignee: Tomy Company, Ltd., Tokyo (JP)

( * ) Notice: Subject to any disclaimer, the term of this patent is extended or adjusted under 35 U.S.C. 154(b) by 0 days.

(21) Appl. No.: 12/213,794

(22) Filed: Jun. 24, 2008

(65) Prior Publication Data

US 2008/0318491 A1 Dec. 25, 2008

(30) Foreign Application Priority Data

Jun. 25, 2007 (JP) ..... 2007-166743
Jun. 25, 2007 (JP) ..... 2007-166745

(51) Int. Cl.
*A63H 17/267* (2006.01)
*A63H 17/39* (2006.01)

(52) U.S. Cl. ..... 446/466; 446/427; 446/428; 446/437; 446/454; 446/456; 446/465; 446/469; 446/470

(58) Field of Classification Search ..... 446/427, 446/428, 437, 454, 456, 465, 466, 469, 470
See application file for complete search history.

(56) References Cited

U.S. PATENT DOCUMENTS

| | | | | |
|---|---|---|---|---|
| 4,674,585 | A * | 6/1987 | Barlow et al. | 180/14.1 |
| 4,696,655 | A * | 9/1987 | D'Andrade et al. | 446/466 |
| 4,813,906 | A * | 3/1989 | Matsuyama et al. | 446/457 |
| 5,609,510 | A * | 3/1997 | Stubenfoll et al. | 446/456 |
| 5,676,585 | A * | 10/1997 | Nuermberger et al. | 446/428 |
| 6,095,891 | A * | 8/2000 | Hoeting et al. | 446/440 |
| 6,234,866 | B1 * | 5/2001 | Ben-Yakar et al. | 446/431 |
| 6,394,876 | B1 * | 5/2002 | Ishimoto | 446/428 |
| 6,394,878 | B1 * | 5/2002 | Wang | 446/469 |
| 6,565,412 | B1 * | 5/2003 | Thrasher | 446/465 |
| 6,620,023 | B2 * | 9/2003 | Yeung | 446/466 |
| 6,648,722 | B2 * | 11/2003 | Lynders et al. | 446/437 |
| 6,758,719 | B1 * | 7/2004 | Nava | 446/466 |
| 6,764,376 | B2 * | 7/2004 | Agostini et al. | 446/466 |
| 6,767,272 | B2 * | 7/2004 | Santarsiero | 446/466 |
| 6,793,555 | B1 * | 9/2004 | Tilbor et al. | 446/456 |
| 7,335,084 | B2 * | 2/2008 | Sato | 446/469 |
| 2004/0002286 | A1 * | 1/2004 | Agostini et al. | 446/491 |

FOREIGN PATENT DOCUMENTS

| | | |
|---|---|---|
| GB | 2182859 | 5/1987 |
| JP | 36-5631 | 3/1961 |
| JP | 43-25303 | 10/1968 |

(Continued)

OTHER PUBLICATIONS

Extended European Search Report and Opinion dated Sep. 25, 2008 in corresponding European Application No. 08104454.7.

(Continued)

*Primary Examiner* — Gene Kim
*Assistant Examiner* — Alexander Niconovich
(74) *Attorney, Agent, or Firm* — Staas & Halsey LLP

(57) ABSTRACT

Disclosed is an automobile toy, including: a first chassis to support an axle of a front wheel; and a second chassis to support an axle of a rear wheel, wherein the first and second chassis are rotatably connected with each other by a rotating shaft that lies along a width direction of the automobile toy, and a spring for biasing the first and second chassis is arranged between the first and second chassis, so as to bias the front wheel and the rear wheel to an approaching direction to the ground.

9 Claims, 4 Drawing Sheets

FOREIGN PATENT DOCUMENTS

| | | |
|---|---|---|
| JP | 45-10345 | 5/1970 |
| JP | 53-36511 | 3/1978 |
| JP | 7-313738 | 12/1995 |
| JP | 2004-329372 | 11/2004 |
| SE | 178337 | 2/1962 |

OTHER PUBLICATIONS

Japanese Patent Office Action dated Oct. 26, 2010 in Application No. 2007-166745.

English Abstract for Patent No. JP7-313738, publication date Dec. 5, 1995.

Office Action, Decision of Refusal, issued in Japanese Priority Application No. 2007-166745 dated Mar. 1, 2011.

Jun. 23, 2011 Office Action in Taiwanese Application No. 097120630 (the two U.S. Patent Nos. 4,674,585 and 5,609,510 cited in the Action are already of record herein).

Japanese Patent Office Action dated Mar. 27, 2012 in Application No. 2007-166745.

* cited by examiner

AUTOMOBILE TOY

BACKGROUND OF THE INVENTION

1. Field of the Invention

The present invention relates to an automobile toy.

2. Related Art

Heretofore, for example, a radio-operated automobile toy has a suspension device in order to mitigate a shock added to a body through front wheels when running over a bumpy road surfaces. The suspension device is, for example, configured to set the front wheels to be movable in regard to the chassis in a vertical direction, configured to bias each front wheel downwardly with respect to the chassis by one coil spring, respectively, and configured to mitigate the shocks added to the body through the front wheels when running, by the coil springs.

By the way, such an automobile toy as described above has a structure, wherein a lower surface of the chassis supporting front and rear axles is flat, and the body is attached to the flat chassis (see, for example, Japanese Patent Application Laid-Open Publication No. 2004-329372).

However, the invention disclosed in Japanese Patent Application Laid-Open Publication No. 2004-329372 has a problem that producing an automobile toy is difficult, because the suspension is complicated due to having to make the chassis support right and left wheels movable in regard to the chassis in a vertical direction, and biasing each wheel downwardly with respect to the chassis by one compression spring, respectively.

SUMMARY OF THE INVENTION

The present invention was made in view of the problem mentioned above. It is, therefore, a main object of the present invention to provide an automobile toy, which can effectively mitigate shocks added to a vehicle body by more simple structure than before.

According to an aspect of the present invention, there is provided an automobile toy, including: a first chassis to support an axle of a front wheel; and a second chassis to support an axle of a rear wheel, wherein the first and second chassis are rotatably connected with each other by a rotating shaft that lies along a width direction of the automobile toy, and a spring for biasing the first and second chassis is arranged between the first and second chassis, so as to bias the front wheel and the rear wheel to an approaching direction to the ground.

BRIEF DESCRIPTION OF THE DRAWINGS

The above and other objects, advantage and features of the present invention will become more fully understood from the detailed description given hereinbelow and the appended drawings which are given by way of illustration only, and thus are not intended as a definition of the limits of the present invention, and wherein.

DETAILED DESCRIPTION OF THE PREFERRED EMBODIMENTS

In the following, an automobile toy according to an embodiment of the present invention will be described with reference to the attached drawings.

Figure 1:
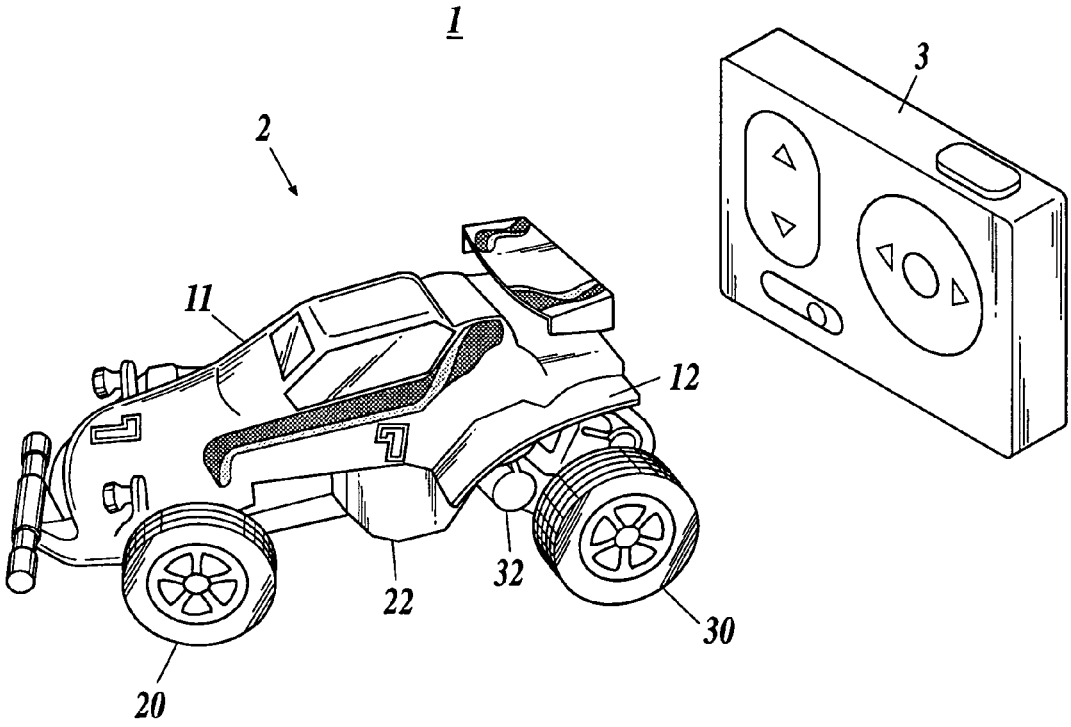
FIG. 1 is an external view of a remote control automobile toy according to a present embodiment.

FIG. 1 shows an external view of an off-road remote control toy 1 according to the present embodiment. The remote control toy 1 is a toy including an automobile toy 2 according to the present embodiment, and a wireless remote controller 3 for radio-operating the automobile toy 2, wherein users can make the automobile toy 2 drive on a-non-pavement road surfaces such as gravel or soil, as well as on a-level ground.

Figure 2:
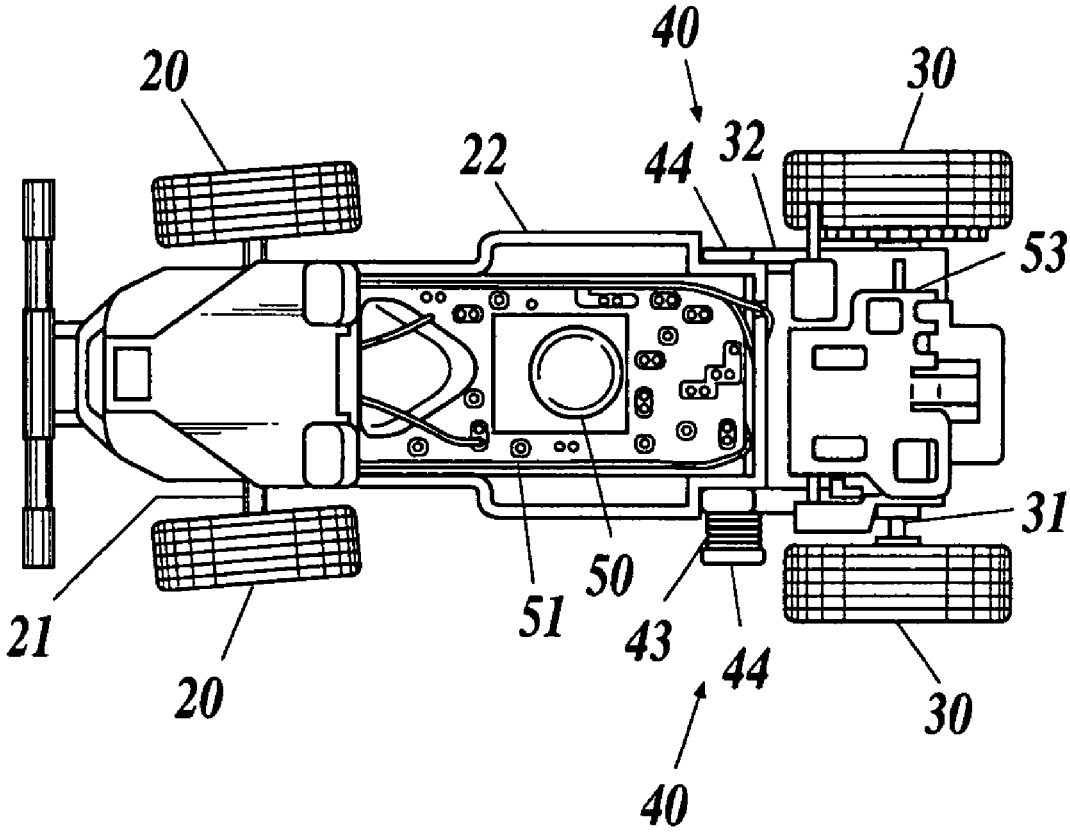
FIG. 2 is a top view showing the automobile toy according to the present embodiment with its body removed.
Figure 3A:
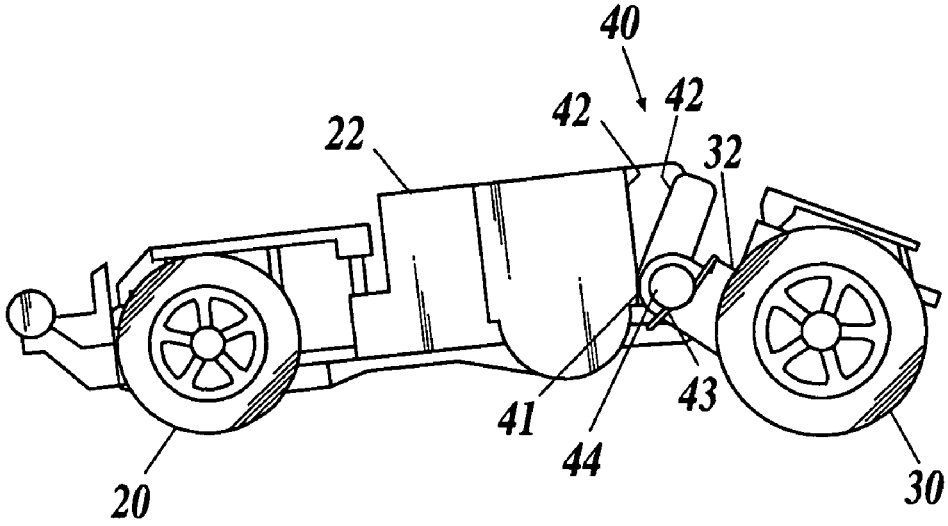
FIG. 3A is a side view showing the automobile toy according to the present embodiment with its body removed on condition that a first stopper works.
Figure 3B:
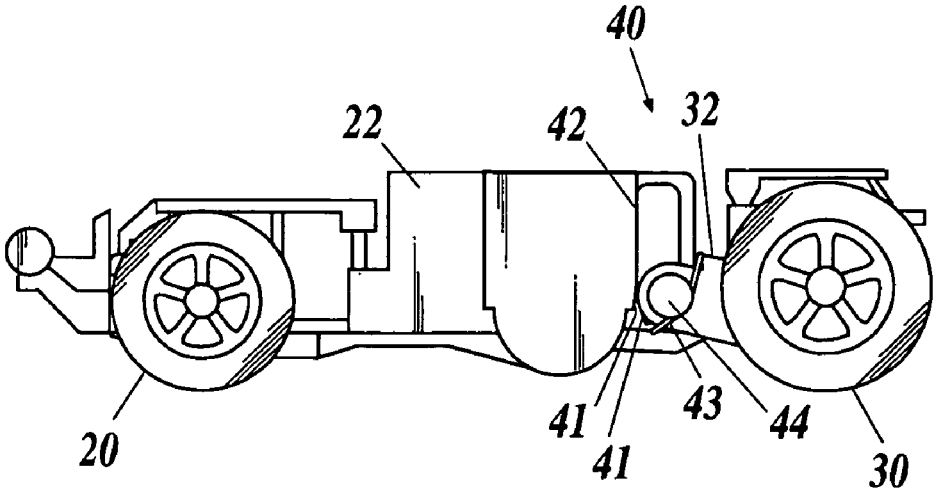
FIG. 3B is a side view showing the automobile toy according to the present embodiment with its body removed on condition that a second stopper works.

FIG. 2 shows a top view of the automobile toy 2 according to the present embodiment with its body 11 removed; FIG. 3A shows a side view of the automobile toy 2 according to the present embodiment with its body 11 removed on condition that a first stopper works; and FIG. 3B shows a side view of the automobile toy 2 according to the present embodiment with its body 11 removed on condition that a second stopper works. The automobile toy 2 includes a chassis 22 (first chassis) for front wheels pivotally supporting an axle 21 for front wheels, the axle 21 connects right and left front wheels 20, 20, and a chassis 32 (second chassis) for rear wheels pivotally supporting an axle 31 for rear wheels, the axle 31 connects right and left rear wheels 30, 30. The chassis 22 and 32 are connected with each other by connection portions 40, 90, which are arranged in two places, both side surfaces of the chassis, in an intermediate part of the both axles. Incidentally, the words "an intermediate part of the both axles" means such positions as between the axle 21 for front wheels and the axle 31 for rear wheels in back and forth direction of the chassis.

The chassis 22 has a storage space in between the axle 21 and the connection portion 40. The storage space contains a receiving apparatus 50 for receiving radio-signals from the wireless remote controller 3, a controller 51 for controlling each part by received radio-signals, and a steering apparatus (not shown) for steering the front wheels by an instruction from the controller 51. Moreover, batteries (not shown) for supplying electricity is placed in between the controller 51 and the bottom surface of the storage space. And then, the body 11 is attached to the chassis 22.

The chassis 32 contains a motor 53 for driving rear wheels 30, 30 via the axle 31. The motor 53 receives driving instruction from the controller 51 contained in the chassis 22, and supplied electricity from the batteries (not shown) contained in the chassis 22, through the connection portion 40.

As shown in FIG. 2, the two connection portions 40, 40 are rotatably connected around a rotating shaft 44 that lies along a width direction of the automobile toy 2. Because the two connection portions 40, 40 are separated from each other in width direction of the automobile toy 2, the two connection portions 40, 40 restrain both chassis from twisting around the connection portions 40, and stabilize a rotation of the rotating shaft 44.

Moreover, as shown in FIG. 3, a rotational range of the chassis 22 and the chassis 32 at the connection portion 40 is restricted by first stopper surfaces 41, 41 and second stopper surfaces 42, 42. More specifically, the respective first stopper surfaces 41, 41 are formed on the side of the chassis 22, and on the side of the chassis 32, at lower sides of the connection portions 40, 40. As shown in FIG. 3A, the first stopper surfaces 41, 41 restrict a rotation of the connection portion 40, 90, by abutting with each other, to a direction that the connection portions 40, 90 draw apart from the road surface. In the same way, the respective second stopper surfaces 42, 42 are formed on the side of the chassis 22, and on the side of the chassis 32, at upper sides of the connection portions 40, 40. As shown in FIG. 3B, the second stopper surfaces 42, 42 restrict a rotation of the connection portions 40, 40, by abutting with each other, to a direction that the connection portions 90, 40 move closer to the road surface.

Incidentally, an abutment position of the first stopper surfaces 41, 41 is set up to a degree that a slant of both chassis may not detract appearance of the automobile toy 2 as an off-road automobile toy, and an abutment position of the second stopper surfaces 42, 42 is set up to a degree that the bottom surface of the chassis may not abut the road surface.

A twist spring 43 is arranged on one side (downward side in FIG. 2, frontward side in FIG. 3) of the connection portion 40. The twist spring 43 is twisted around the rotating shaft 44 on one side of the chassis, with one end being fixed to the chassis 22 and another end being fixed to the chassis 32. Preferably, the twist spring 43 should be arranged only in one part of the side surface of the chassis. By arranging the twist spring 43 only in one part of one side surface of the chassis, a space for some parts inside the chassis should be cordoned off, and an installation itself of the twist spring 43 will become easier.

The twist spring 43 functions, in a normal condition, as a biasing member for biasing the chassis 22 and 32, so as to set both chassis in condition that the connection portions 40, 40 are positioned upwardly in regard to the both axles on a level ground, that is in flexure state of both chassis, as shown in FIG. 3A. Moreover, the twist spring 43 functions as a shock absorber for absorbing oscillation added to the automobile toy 2 in a vertical direction. Therefore, there is no need for the automobile toy 2 to possess complicated suspension devices. Moreover, because the twist spring 43 biases both chassis so as to be in flexure state in a normal condition, the twist spring 43 can shorten a total length of the automobile toy 2.

Incidentally, the twist spring 43 may not be restricted to making both chassis in flexure state or to be a twist spring, if only the twist spring 43 could bias the front wheels 20, 20 and the rear wheels 30, 30 to the direction of making both wheels connected to ground, that is to the direction of making both chassis in flexure state.

Moreover, the connection portion 40 will not be disturbed to rotate, by the body 11, because the body 11 is fixed only on the chassis 22. When constituting the automobile toy 2 in this way, for example, the body 11 should be divided into a body for front wheels and a body for rear wheels, then rotatably connect the bodies with each other in the same way as the chassis. Thus, the body for front wheels and the body for rear wheels may be fixed to the chassis for front wheels and the chassis for rear wheels, respectively, as long as the bodies do not disturb a rotation of the connection portion 40.

In addition, because both chassis are connected to extend upwardly in a normal condition (see FIG. 3A) at connection portion 40, and a rear side of the body 11, which is fixed to the chassis 22, is lifted upwardly, such clearance will prevent a fender 12 of the rear wheel portion of the body 11 from abutting the rear wheels 30, 30, on condition that the second stopper surfaces 42, 42 come into contact with each other (see FIG. 3B).

Subsequently, an outline of a movement of the remote control toy 1 in the present embodiment will be explained.

As for the remote control toy 1, users can let the automobile toy 2 run, as the users like, by operating the remote controller 3. At first, a radio signal in relation to the operation is emitted from the remote controller 3, and the receiving apparatus 50 of the automobile toy 2 receives the radio signal. Then, according to an instruction from the controller 51, which receives the radio signal, the steering servo performs steering motion, the motor 53 performs driving motion of the rear wheels 30, 30, and the users can let the automobile toy 2 run in accordance with the operation of the remote controller 3.

Subsequently, the motion of the automobile toy 2 running over the concave-convex road surface will be explained.

Figure 4:
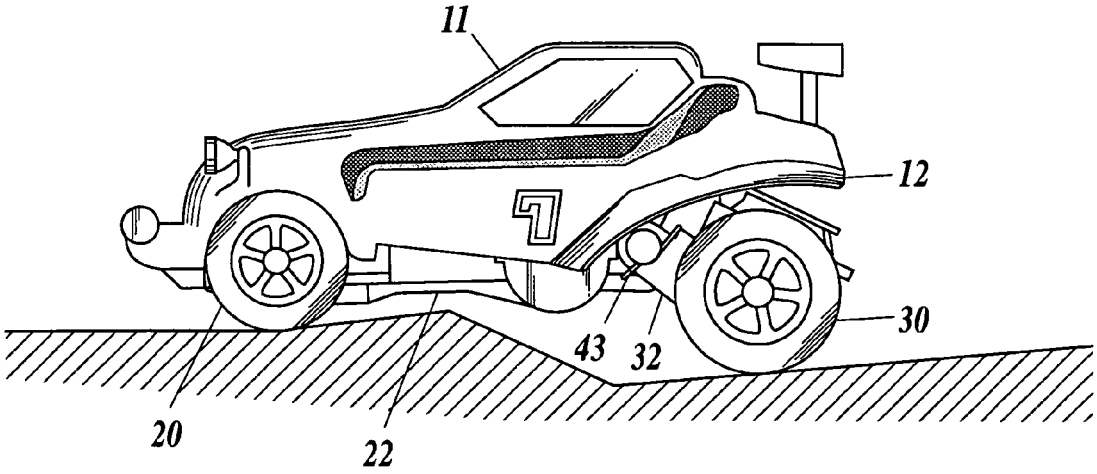
FIG. 4 is a side view showing the automobile toy running over a road surface having convex portions, according to the present embodiment.

FIG. 4 shows a side view of the automobile toy 2 running over a road surface having convex portions.

When the automobile toy 2 runs over the road surface having convex portions, the front wheels 20, 20 get over the convex portion at first. At this time, the front wheels 20, 20 are able to get over the convex portion with a strong grip, because both chassis are biased by the twist spring 43 to keep the flexural condition normal, and the front wheels 20, 20 are biased toward the ground. Moreover, although an oscillation in a vertical direction may be added to the automobile toy 2, the twist spring 43 functions as a shock absorber to absorb the oscillation. Therefore, the shocks added to the automobile toy 2 will be relieved. Moreover, the fender 12 and the rear wheels 30, 30 will not contact with each other even when the automobile toy 2 oscillates up and down, because the clearance between the fender 12 and the rear wheels 30, 30 is sufficiently large.

Next, as shown in FIG. 4, the chassis 22 and 32 straddle the convex portion. At this time, the automobile toy 2 can run without either chassis hitting the convex portion of the road surface, because the chassis 22 and 32 are connected between the axle for front wheels and the axle for rear wheels in flexure state so as to extend above the road surface, that is the chassis are connected to form a concave portion.

Finally, the rear wheels 30, 30 get over the convex portion. At this time, the automobile toy 2 can get over the convex portion, because both the chassis are biased by the twist spring 43 to keep flexure state in a normal condition, and the rear wheels 30, 30 are biased toward the ground. Moreover, although an oscillation in a vertical direction may be added to the automobile toy 2, the twist spring 43 functions as a shock absorber to absorb the oscillation, and then, the shock added to the automobile toy 2 will be relieved. Moreover, the fender 12 and the rear wheels 30, 30 will not contact with each other even when the automobile toy 2 oscillates up and down, because the clearance between the fender 12 and the rear wheels 30, 30 is sufficiently large.

As described above, according to the remote control toy 1 in accordance with the present invention, the shocks added to a vehicle body can effectively be relieved by the simple structure, because the twist spring 43 functions as a shock absorber to absorb the oscillation added to the automobile toy 2 in a vertical direction, and there is no need for suspension devices for a respective wheel or a respective axle.

Moreover, the twist spring 43 is easy to be assembled in itself, because the twist spring 43 is arranged on a side surface side of the chassis, and the twist spring 43 does not take up space for other parts in the chassis.

Moreover, the twist spring 43 is easy to be assembled in itself, because the twist spring 43 is arranged only in one place, and the space in the chassis is not disturbed compared to a conventional automobile toy having suspension devices arranged in a plurality of places.

Moreover, the wheels can exert powerful grip relative to a rugged road surface, because the front wheels 20, 20 and the rear wheels 30, 30 are biased toward the ground.

Moreover, the total length of the automobile toy 2 can be shortened, because the chassis are kept in flexure state in a normal condition.

Moreover, space for other parts will be available in the chassis, because only the one twist spring 43 is necessary to absorb, as a shock absorber, shocks added to the automobile toy 2.

Moreover, the chassis are prevented from being twisted at these connecting portions 40, 40, and the rotation of the rotating shaft 44 can be stabilized, because the two connecting portions 40, 40 connecting the chassis 22 and 32 are separated from one another in a width direction of the vehicle body.

The entire disclosure of Japanese Patent Application No. 2007-166743 filed on Jun. 25, 2007 and Japanese Patent Application No. 2007-166745 filed on Jun. 25, 2007 including description, claims, drawings and summary are incorporated herein by reference in its entirely.

Although various exemplary embodiments have been shown and described, the invention is not limited to the embodiments shown. Therefore, the scope of the invention is intended to be limited solely by the scope of the claims that follow.

What is claimed is:

1. A toy, comprising:

a first chassis for supporting an axle of a front wheel;

a second chassis for supporting an axle of a rear wheel, wherein the first and second chassis are rotatably connected at a connection portion to each other by a shaft that extends in a width direction of the toy, said shaft being intermediate of the first axle with front wheel and the second axle with rear wheel, and wherein the first and second chassis move between an extension state, wherein the first and second chassis are arranged relatively flat and the front wheel and the rear wheel are positioned at a first distance, on an underside of the first and second chassis, and a flexure state, wherein the first and second chassis are angled relative to each other and the front wheel and the rear wheel are positioned at a second, shorter distance, on the underside of the first and second chassis, and wherein the toy has a weight;

only one body that is directly attached to only the first chassis but not to the second chassis, and the second chassis lacks a body, wherein the body does not change its position relative to the first chassis in either the extension or flexure states; and a spring, arranged on the shaft, for maintaining biasing of the first and second chassis in the flexure state against the weight of the toy as a normal operating condition of the toy.

2. The toy according to claim 1, wherein the spring is a twist spring.

3. The toy according to claim 2, wherein the twist spring is mounted on a side of the first and second chassis.

4. The toy according to claim 2, wherein the twist spring is arranged only at one part of the toy.

5. The toy according to claim 1, wherein the spring is a twist spring, the twist spring is twisted around the shaft, and a first end of the twist spring contacts the first chassis and a second end of the twist spring contacts the second chassis.

6. The toy according to claim 1, wherein the first and second chassis are connected to each other at two places, which are separated from each other in the width direction of the toy.

7. The toy according to claim 1, further comprising:

a receiving apparatus for receiving control signals from a remote controller;

a driving apparatus for rotating the axle of the rear wheel; and a controller for controlling the driving apparatus.

8. A toy for running on the ground, comprising:

a first chassis supporting a front wheel;

a second chassis supporting a rear wheel, wherein the first and second chassis pivotably connect to each other at a connection portion intermediate of the front wheel and the rear wheel, and wherein the first and second chassis move, based on respective stoppers, between an extension state, wherein the first and second chassis are arranged relatively flat and the front wheel and the rear wheel are positioned at a first distance, on an underside of the first and second chassis, and a flexure state, wherein the first and second chassis are angled relative to each other, the front wheel and the rear wheel are positioned at a second, shorter distance, on the underside of the first and second chassis, wherein the stoppers include at least one first stopper surface formed on at least one side of upper and lower sides of the connection portion, at a first chassis side, and at least one second stopper surface formed on at least one side of the upper and lower sides of the connection portion, at a second chassis side, to contact the first stopper surface; and wherein the toy has a weight;

only one body that is directly attached to only the first chassis but not to the second chassis, and the second chassis lacks a body, wherein the body does not change its position relative to the first chassis in either the extension or flexure states; and a spring, connected between the first and second chassis, for maintaining biasing of the first and second chassis into the flexure state against the weight of the toy as a normal operating condition of the toy, and for biasing only the front and rear wheel against the ground.

9. The toy according to claim 1 further comprising:

at least one first stopper surface formed on at least one side of upper and lower sides of the connection portion, at a first chassis side, and at least one second stopper surface formed on at least one side of the upper and lower sides of the connection portion, at a second chassis side, so as to define at least one of the extension state and the flexure state, and to contact the first stopper surface.

* * * * *